US005658178A

United States Patent [19]

Varga

[11] Patent Number: 5,658,178

[45] Date of Patent: Aug. 19, 1997

[54] FLOATING DEVICES ASSEMBLED FROM PLASTIC BOTTLES OR ALUMINUM CANS

[76] Inventor: Thomas L. Varga, 1622 Taylor Dr., North Brunswick, N.J. 08902

[21] Appl. No.: 534,386

[22] Filed: Sep. 27, 1995

[51] Int. Cl.[6] ..... B63B 22/00; B63C 9/08

[52] U.S. Cl. ..... 441/1; 441/35; 441/129; 114/267

[58] Field of Search ..... 114/219, 343, 114/264, 266, 267, 263; 441/1, 6, 44–46, 40, 35, 80, 88, 125, 126, 129, 130, 131, 136, 47, 50; 405/219

[56] References Cited

U.S. PATENT DOCUMENTS

| | | | |
|---|---|---|---|
| 3,802,367 | 4/1974 | Moore | 114/65 R |
| 3,878,803 | 4/1975 | Leverton | 114/267 |
| 4,729,335 | 3/1988 | Vidovic | 114/266 |
| 4,889,511 | 12/1989 | Herman | 441/88 |
| 4,988,317 | 1/1991 | Rubinsak et al. | 441/46 |
| 5,117,775 | 6/1992 | Northam et al. | 114/267 |
| 5,235,929 | 8/1993 | Chester et al. | 114/266 |
| 5,372,532 | 12/1994 | Robertson, Jr. | 441/1 |

*Primary Examiner*—Edwin L. Swinehart
*Attorney, Agent, or Firm*—Judith Adele Plotkin

[57] ABSTRACT

Frames for flotation devices are described with integrally incorporated attachment sites for the air tight attachment of recycled plastic bottles, aluminum beverage cans, or other bouyant containers. Several embodiments of flotation devices made with such frames are described including floating mattresses, a raft, a baby seat, a bouy, a pool pillow, and a bumper. The devices discussed are easy to transport and to stow. Further, they are inexpensive and provide an incentive to recycle used bouyant bottles and cans for making the flotation devices of this invention.

20 Claims, 4 Drawing Sheets

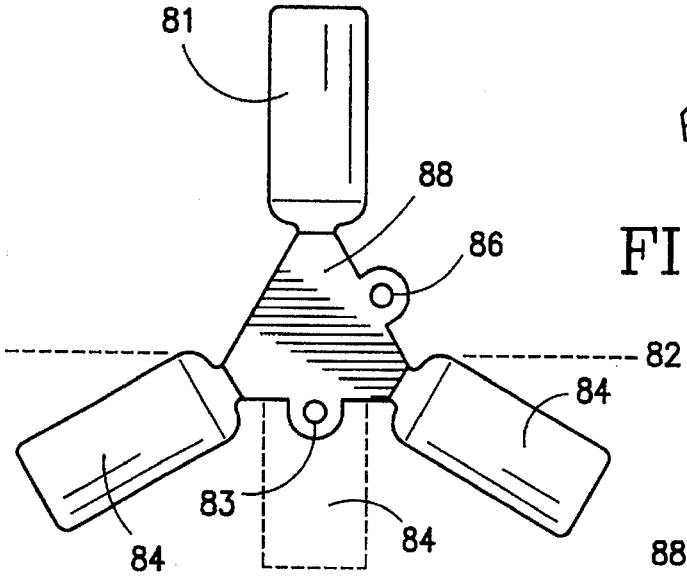
FIG. 8
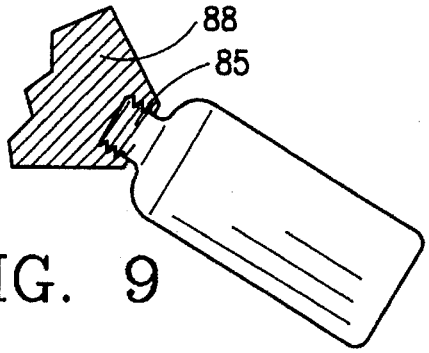
FIG. 9
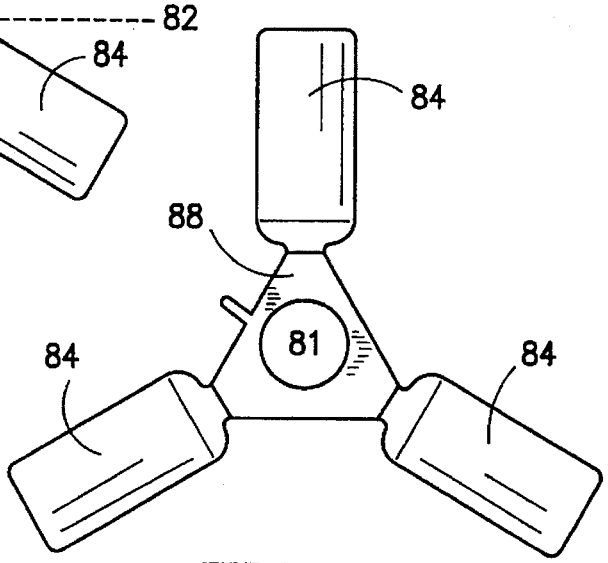
FIG. 7
FIG. 13
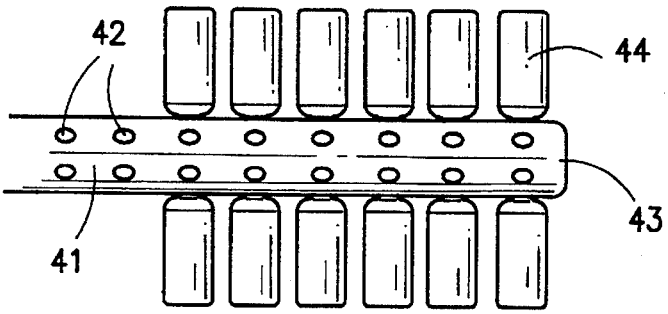
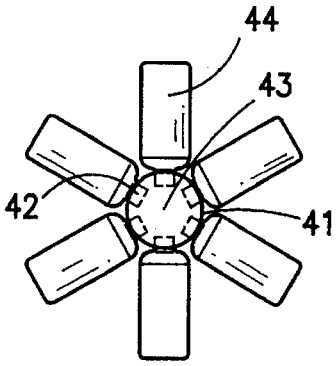
FIG. 14
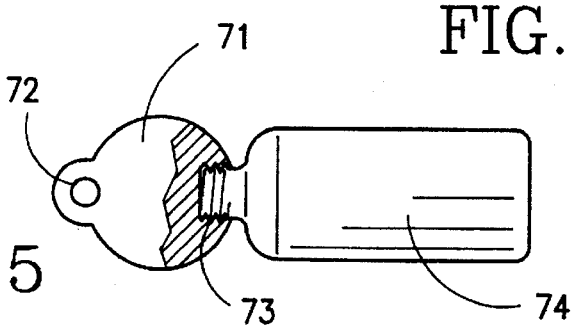
FIG. 15

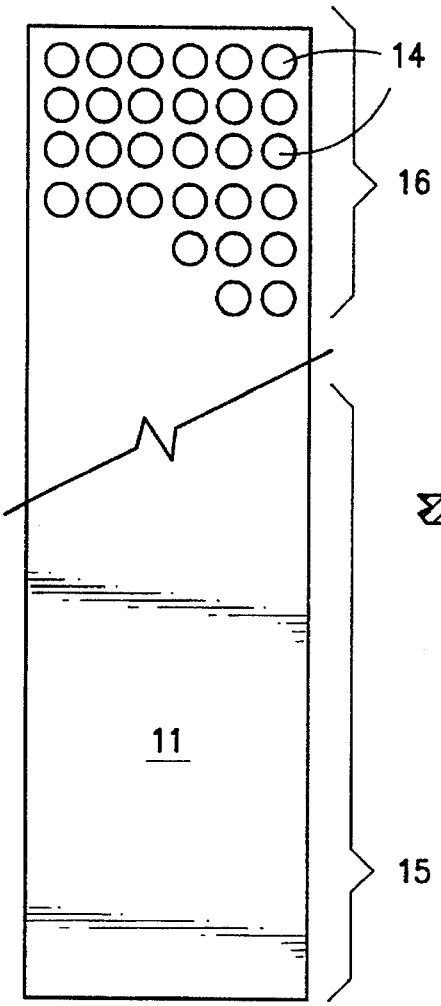
FIG. 10
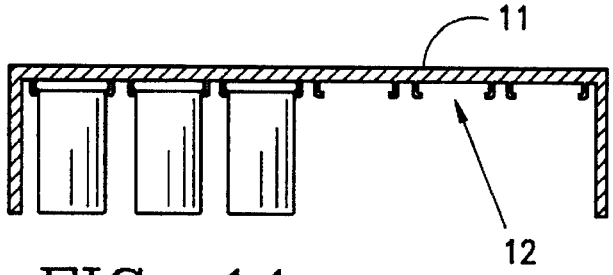
FIG. 11
FIG. 12
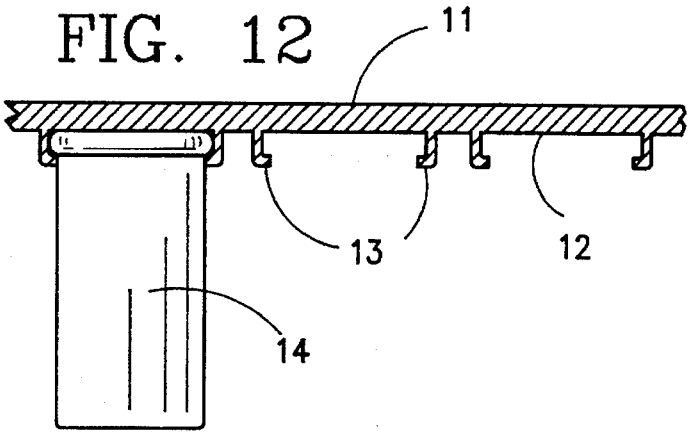
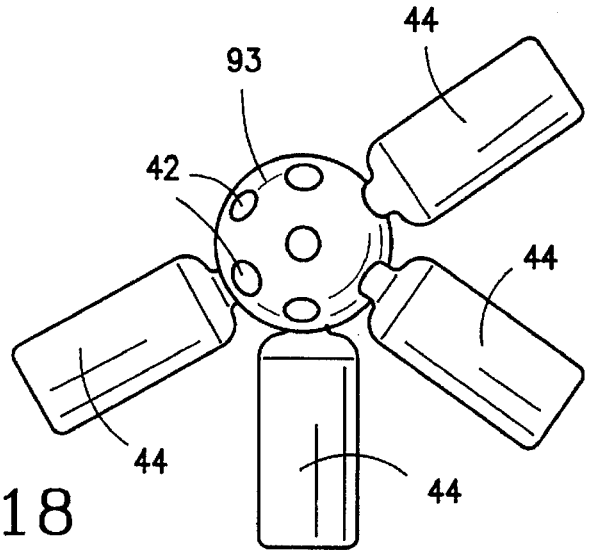
FIG. 18
FIG. 19
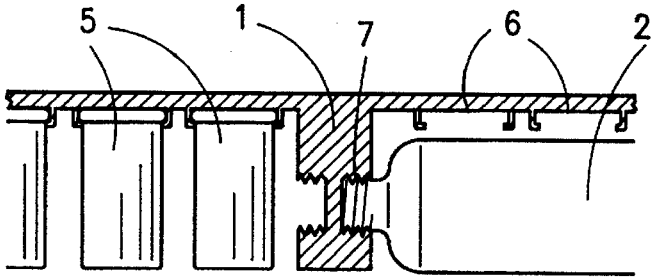

FLOATING DEVICES ASSEMBLED FROM PLASTIC BOTTLES OR ALUMINUM CANS

BACKGROUND

Despite many programs for the recycling of plastic bottles and aluminum cans, a large number of these items are still disposed of in the municipal garbage from households and businesses. In order to reduce the volume of solid waste generated by the inclusion of such bouyant containers in the garbage, an alternative usage for the containers would be of great value and interest. Since the containers float, a possible usage would be in flotation devices assembled from modular components. Such devices could be assembled and disassembled easily at home or any other convenient location. If used for personal recreational pleasure, these devices could be an incentive for the recycling of plastic bottles, aluminum cans, or other bouyant used containers.

Use of plastic bottles or aluminum cans in floating pontoons or docks has been described in the literature and discussed below.

Leverton in U.S. Pat. No. 3,878,803 discloses the use of beverage cans sealed in a cylindrical plastic tubes as a pontoon. Watertightness depends on adequate sealing of the tubes.

Similarly, in U.S. Pat. No. 5,117,775 Northam, et al. use sealed plastic bottles enclosed in a hollow outer shell to make a flotation device.

Moore in U.S. Pat. No. 3,802,367 shows the use of cans secured together within a skin as walls for a water-traversing vehicle. This vehicle is preferably stabilized by balloons.

Chester et al. in U.S. Pat. No. 5,235,929 describes a docking system comprised of modules with walls containing plastic containers joined together and to the inside of the hollow containers which make the outer walls.

Rubinsak et al. in U.S. Pat. No. 4,988,317 use floating buckets sealed into a pontoon float structure with air-tight snap lids which are permanently bolted to the structure.

None of these references suggest the use of cans and bottles for personal recreational flotation devices such as floating mattresses, rafts, or baby seats. Additional uses not suggested include bouys and bumpers for boats or docks. Further, none of these devices have difficult-to-break integrally incorporated attachment sites with airtight sealing. The present invention overcomes this and other problems in the prior art.

SUMMARY OF THE INVENTION

The instant invention is a flotation device made of a frame or core in which there are sites of integrally molded bottle caps and/or aluminum can snap lids. Empty bottles and cans can be attached at appropriate sites to provide bouyancy. They can be removed for easy portability and storage. Soft, inner gaskets may be used to provide airtight seals at the attachment sites.

The flotation devices of this invention can be inexpensively manufactured and made widely available as merchandise, promotional items, etc. They float readily and can be repaired easily by replacement of defective air compartments (the plastic bottles and/or aluminum cans). Further, since bouyancy comes from multiple modules, these devices are hard to sink. By varying the number and sizes of the bouyant containers attached, the degree of bouyancy in the parts of the device can be adjusted. Further, the frame may include other integrally incorporated items of utility such as eyes for ropes or holders on the shell surfaces for glasses, lotions, cups, etc.

BRIEF DESCRIPTION OF THE FIGURES

FIG. 7 shows the top view of a bouy using plastic bottles for flotation.

FIG. 8 is the side view of FIG. 7.

FIG. 9 is another embodiment of the screw cap socket usable with the device shown in FIGS. 7 and 8.

FIG. 10 shows top (15) and bottom (16) views of a mattress with beverage cans for bouyancy.

FIG. 11 is the cross-section of the mattress in FIG. 10.

FIG. 12 shows a snap lids for holding cans which are integrally molded into a frame of this invention.

FIG. 13 shows the side view of a winterizing pool "pillow".

FIG. 14 shows the end view of the pool "pillow" of FIG. 13.

FIG. 15 shows a boat or dockside bumper.

FIG. 18 shows a spherical core pool pillow.

FIG. 19 shows the cross-section of a mattress which can use both cans and bottles for bouyancy.

DETAILED DESCRIPTION OF THE EMBODIMENTS

Devices of this invention consist of frames made of appropriate semi-hard or hard plastic or other suitable materials. The frame can have a shell, a core, or both. The frame is manufactured with the integral incorporation of standard sized screw cap-type attachment sites, circular snap lid-type attachment sites, or both as desired. Multiple cap and lid sizes can be incorporated into a single frame to provide the opportunity to use a variety of waste container types.

Empty plastic bottles are tightly screwed into appropriate screw cap sites. A soft inner gasket may be placed inside each screw cap to ensure an airtight seal. Similarly, empty beverage cans are snapped into the lid sites. Each lid is provided with a flexible edge which tightly grips the rim of the can. When the upper rim is gripped by the lid, the drinking hole is covered and sealed off.

Figure 1:
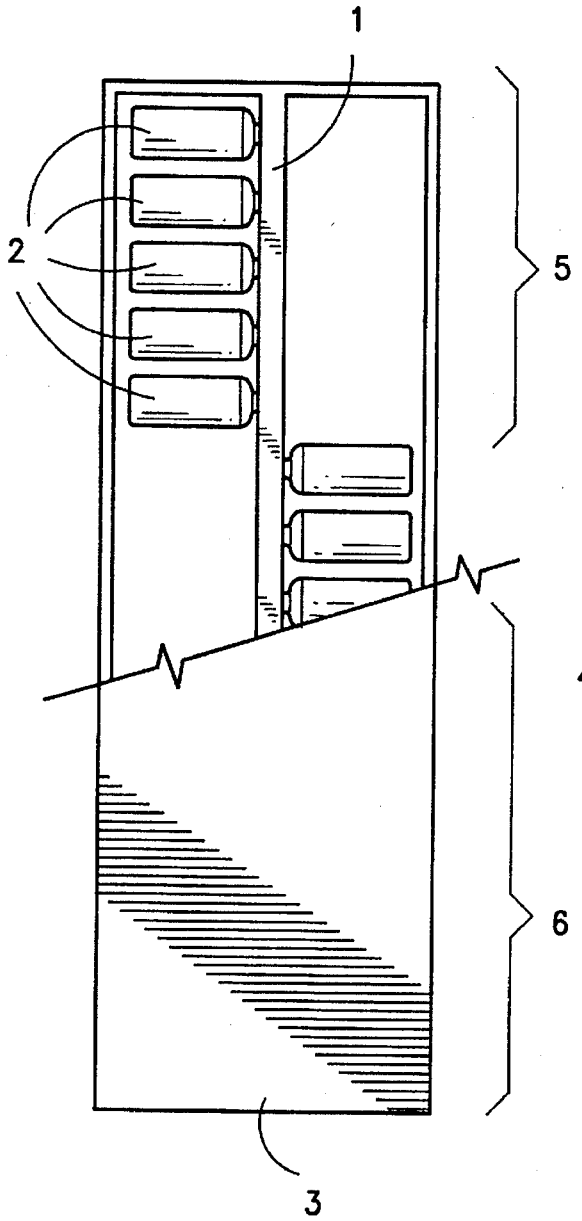
FIG. 1 shows top (6) and bottom (5) views of a floating mattress assembled from plastic bottles.
Figure 2:
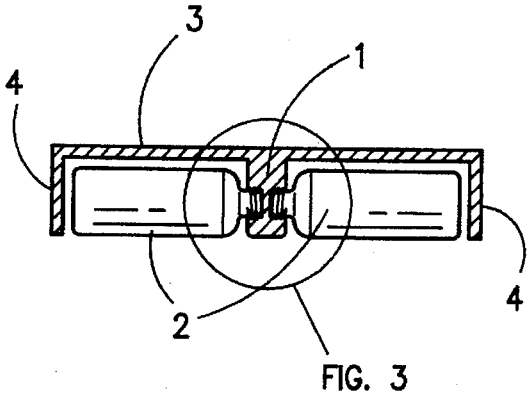
FIG. 2 shows the cross-section of the mattress in FIG. 1.

The floating mattress of FIG. 1 has a frame made of a semi-hard material which has a middle rib (51) to which are attached plastic bottles (2). The plastic shell (3) of the frame covers the bottles. As seen in FIG. 2, the plastic shell (3) also forms the sides (4) of the mattress as well as covering the bottles (2) and providing a rib (1) onto which the bottles are secured.

Figure 3:
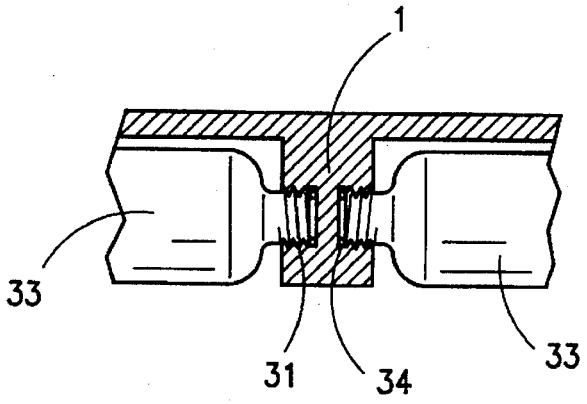
FIG. 3 shows screw cap sockets integrally molded into a section of the frame of a flotation device of this invention.

FIG. 3 shows screw cap sockets (31) incorporated into the rib (1) of the frame shown in FIGS. 1 and 2. Bottles (33) are screwed into the sockets which may contain gaskets (34) for tighter seals.

Figure 5:
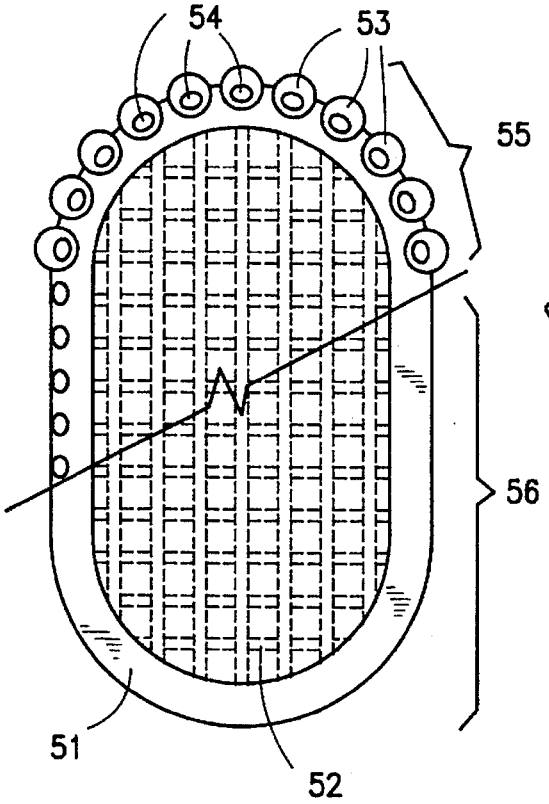
FIG. 5 shows top (55) and bottom (56) views of a tubing raft with plastic bottles for bouyancy.
Figure 6:
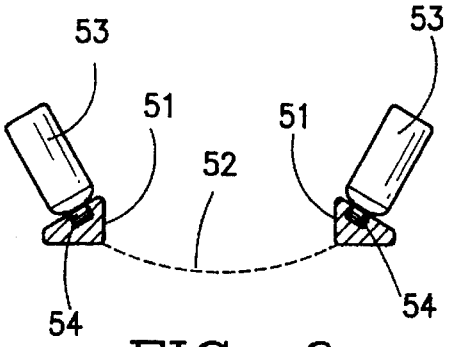
FIG. 6 shows the cross-section of the raft in FIG. 5.
Figure 4:
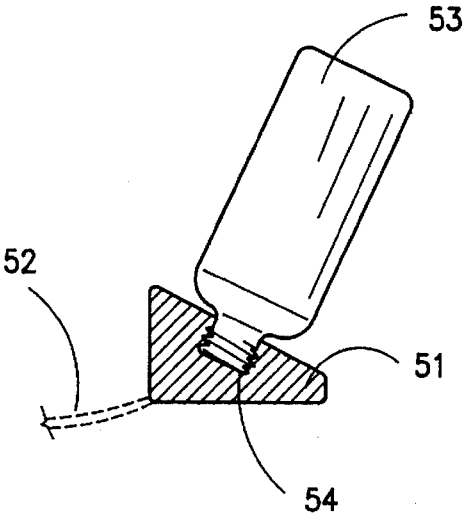
FIG. 4 shows another type of screw cap socket usable with flotation devices of this invention.

FIG. 5 shows a raft which also has a frame (5) of semi-hard material. The frame (5) encircles a section of webbing (52) on which the user can sit or lie. Plastic bottles (53) are attached to the frame (55) and encircle the webbing (52) when all sockets (54) are filled. FIG. 6 shows the cross-section of the raft with components similarly numbered. FIG. 4 shows a close-up of the screw cap sockets used in the raft of FIGS. 5 and 6.

FIGS. 7 and 8 show side and top views respectively of a bouy with a core (88) made of hard material. The bouy has four bottles attached in tetrahedral formation. One of the bottles (81) is above the water surface (82) while the others (84) are below. An anchor chain eye (anchor attachment site) (83) is located below the water surface, beneath the bottle which is above the water surface. This eye is on the core opposite the socket (85) for the above the surface bottle (81). Another eye (86) is located above the water surface on the core (88). A rope may be attached to this second eye. FIG. 9 shows a close-up of the screw cap socket (85) usable with the bouy of FIGS. 7 and 8.

FIG. 10 shows another floating mattress embodiment. The covering shell (11) is similar to the shell in FIG. 1. However, instead of a rib for the attachment of bottles, the lower surface (12) has densely packed snap lids (13) integrally molded therewith as seen in FIG. 11 cross-sectional view. FIG. 12 shows an enlarged view of a beverage can (14) snapped into the snap lid (13) on the underside (12) of the shell (11). The mattresses of this embodiment and of the first embodiment (FIGS. 1–2) can further include a perimeter of different floating containers. For instance, the mattress of this embodiment may have a perimeter of plastic bottles or jugs attached. Alternatively, the mattress of FIG. 1 could have an attached perimeter of cans or of bottles of a different size. Additionally, a single frame may have attachment sites for both cans and bottles as depicted in FIG. 19. The numbers are the same as in FIG. 2 with cans (5), sockets (7), and snap lids (6) added on.

FIGS. 13 and 14 show the side and end views of a pool "pillow" used as an ice pressure absorber for winterizing pools. The pool pillow can reduce ice pressure and can support a pool cover when one is used. Several circles of six screw cap sockets (42) for bottles (44) are incorporated into the core surface (41) and centered on the same axis as the core (43). An alternate embodiment uses a spherical core (43) as depicted in FIG. 18.

FIG. 15 shows a boat or dockside bumper which has a plastic base (71) with an eye (72) for a rope and a screw cap socket (73) for attachment to a bottle (74).

Figure 16:
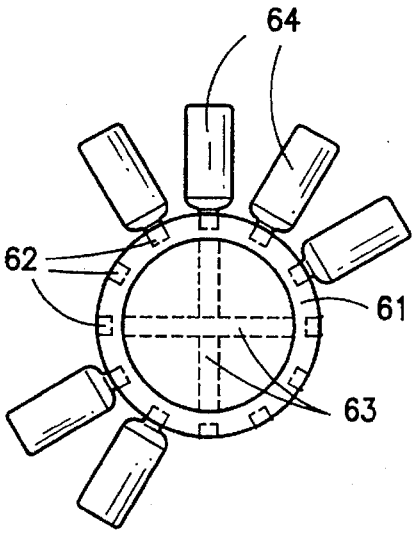
FIG. 16 shows the top view of a floating baby seat.
Figure 17:
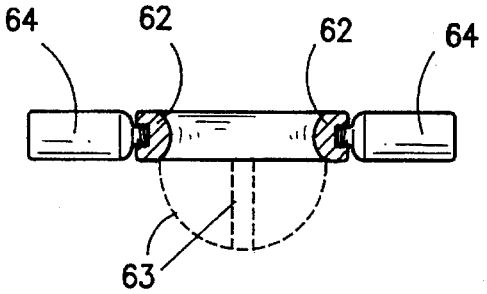
FIG. 17 shows the side view of the seat in FIG. 16.

FIGS. 16 and 17 show a floating baby seat with a circular frame (61) which has screw cap sockets (62) for bottles (64) incorporated around the perimeter of the frame. Within the frame are straps (63) for seating and securing the child. This device is not intended as a safety flotation device. As with all similar devices, it is intended for use under constant adult supervision.

From the embodiments herein described it is evident that depending on the shape of the frame, this invention is applicable to many types of flotation devices. Hence the scope of this invention is not limited to the embodiments herein described, but extends to cover a broader range of equivalents.

What is claimed is:

1. A frame for a flotation device comprising:

a. a suitable material to provide the desired shape and support for said flotation device, wherein said material has an outer surface;

b. at least two attachment sites, each for the attachment of a recycled bouyant container; and c. a means to provide airtight seals at each of said at least two attachment sites wherein said attachment sites are integrally molded with said suitable material for said frame, thereby forming a one piece assembly, and wherein said attachment sites do not protrude beyond said outer surface.

2. A frame as described in claim 1 which is a floating bumper which further comprises an eye on said frame, wherein said eye is for the attachment of a rope and wherein said at least two attachment sites are two attachment sites opening in opposite directions and centered on the same axis.

3. A frame as described in claim 1 which is useable in a pool pillow comprising a spherical core with said attachment sites, wherein said attachment sites are at least six screw cap sockets incorporated into said core.

4. A frame as described in claim 1, which is useable as a floating mattress when bouyant containers are attached, which is further comprised of:

a) an underside section with said attachment sites; and b) a shell attached to said underside section;

wherein said shell covers said underside section when said bouyant containers are attached to said attachment sites on said underside section.

5. A frame as described in claim 4 wherein said attachment sites are snap lids.

6. A frame as described in claim 1 which further comprises a perimeter, said attachment sites on said perimeter, a means suitable as a centrally located seat and a means to secure a person onto said means suitable as a centrally located seat.

7. A frame for a flotation device comprising:

a. a suitable material to provide the desired shape and support for said flotation device;

b. at least two integrally incorporated attachment sites, each for the attachment of a recycled bouyant container; and c. a means to provide airtight seals at each of said at least two attachment sites wherein said at least two attachment sites are of at least two types of which at least one of said types is a screw cap socket and of which at least one of said types is a snap lid.

8. A frame as described in claim 7, which is useable as a floating mattress when bouyant containers are attached, which is further comprised of:

a) a central rib section with a top, with a bottom, and with two sides, each of said two sides containing closely spaced screw cap sockets;

b) a shell attached to said central rib section; and c) a perimeter of at least one type of integrally incorporated attachment sites wherein said at least one type is different from said screw cap sockets, and wherein said shell covers said top and said two sides of said central rib section when said bouyant containers are attached to said attachment sites on said central rib section.

9. A frame as described in claim 7, which is useable as a floating mattress when bouyant containers are attached, which is comprised of:

a) an underside section with integrally incorporated snap lids;

b) a shell attached to said underside section; and c) a perimeter of integrally incorporated attachment sites wherein said attachment sites on said perimeter are screw cap sockets and wherein said shell covers said underside section when said bouyant containers are attached to said attachment sites on said underside section.

10. A frame as described in claim 7, which is useable as a floating mattress when bouyant containers are attached, which is further comprised of:

a) a central rib section with a top, with a bottom, and with two sides, each of said two sides containing closely spaced screw cap sockets;

b) a shell attached to said central rib section and covering said top and said two sides of said central rib section when said bouyant containers are attached to said screw cap sockets on said central rib section; and c) an underside with integrally incorporated snap lids wherein said underside is beneath said shell and is covering said central rib section.

11. A frame for a flotation device comprising:

a. a suitable material to provide the desired shape and support for said flotation device, wherein said material has an outer surface;

b. at least two integrally incorporated attachment sites, each for the attachment of a recycled bouyant container; and c. a means to provide airtight seals at each of said at least two attachment sites;

and wherein said at least two integrally incorporated attachment sites are screw cap sockets.

12. A frame as described in claim 11, which is useable as a floating mattress when bouyant containers are attached, which is further comprises of:

a) a central rib section with a top, with a bottom, and with two sides, each of said two sides containing said screw cap sockets, closely spaced; and b) a shell attached to said central rib section and covering said top and said two sides of said central rib section when said bouyant containers are attached to said screw cap sockets on said central rib section.

13. A frame as described in claim 11 which further comprises a perimeter, said integrally incorporated attachment sites on said perimeter, and a means suitable as a centrally located seat.

14. A frame as described in claim 11 which further comprises a perimeter, said integrally incorporated attachment sites on said perimeter, a means suitable as a centrally located seat and a means to secure a person onto said means suitable as a centrally located seat.

15. A frame as described in claim 11 which is useable as a bouy further comprised of:

a. an anchor chain eye attached to said frame;

b. an second eye for the attachment of a rope wherein said second eye is attached to said frame; and c. four of said screw cap sockets incorporated into said frame spaced in a tetrahedral formation for attachment to four of said bouyant containers.

16. A frame as described in claim 11 which is useable in a pool pillow and which comprises a core rod with at least two coaxial circles each of at least three screw cap sockets incorporated into said core rod.

17. A frame as described in claim 11 which is useable in a pool pillow comprising a spherical core with said attachment sites wherein said attachment sites are at least six screw cap tops incorporated into said core.

18. A frame as described in claim 14 in which said means for securing a person onto said means suitable as a seat are straps for holding a baby securely in place.

19. A frame as described in claim 14 in which said means for securing a person onto said means suitable as a seat are adjustable in order to comfortably secure in place said person regardless of the size of said person.

20. A frame as described in claim 13 in which said means suitable as a seat is also suitable for a person reclining and in which said means suitable as a seat is located centrally to and surrounded by said perimeter to which said means suitable as a seat is attached.

* * * * *